US006123807A

United States Patent [19]

Engström et al.

[11] Patent Number: 6,123,807

[45] Date of Patent: Sep. 26, 2000

[54] METHOD FOR THE CONTINUOUS COOKING OF PULP

[75] Inventors: Johan Engström; Vidar Snekkenes; Krister Olsson; Sören Gustavsson, all of Karlstad; Christofer Lindgren; Mikael Lindström, both of Stockholm, all of Sweden

[73] Assignee: Kvaerner Pulping AB, Sweden

[ * ] Notice: This patent is subject to a terminal disclaimer.

[21] Appl. No.: 08/908,285

[22] Filed: Aug. 7, 1997

Related U.S. Application Data

[63] Continuation-in-part of application No. 08/822,042, Feb. 24, 1997, abandoned, which is a continuation-in-part of application No. 08/801,524, Feb. 18, 1997, Pat. No. 5,824,187.

[51] Int. Cl.[7] ..... D21C 7/12; D21C 7/14

[52] U.S. Cl. ..... 162/17; 162/19; 162/41; 162/62

[58] Field of Search ..... 162/17, 18, 19, 162/41, 42, 62

[56] References Cited

U.S. PATENT DOCUMENTS 5,089,086 2/1992 Silander ..... 162/19

FOREIGN PATENT DOCUMENTS 9001467-1 4/1990 Sweden .

*Primary Examiner*—Dean T. Nguyen
*Attorney, Agent, or Firm*—Fasth Law Offices; Rolf Fasth

[57] ABSTRACT

This invention relates to a new and improved way of continuously cooking fiber material, wherein temperatures and alkaline levels are controlled to be maintained within specific levels in different zones of the digesting process in order to optimize chemical consumption and heat-economy and at the same time achieve very good pulp properties.

28 Claims, 6 Drawing Sheets

FIG. 6

LABORATORY COOKING

GENERAL CONDITIONS

| | |
|---|---|
| Wood specie: | Scandinavian softwood, chips |
| Steaming, minutes | 5 |
| Temperature, °C | 110 |
| Pressure, bar | 1.0 |
| Sulfidity, % | 36.4 |

SPECIFIC CONDITIONS

| | Reference | Present Invention |
|---|---|---|
| Cook no. | ITC 1770 | ITC 1763 |
| IMPREGNATION | | |
| Time, minutes | 45 | 45 |
| Temperature, °C | 125 | 125 |
| Alkali consumption, kg EA/BDMT wood | 99 | 92 |
| CONCURRENT COOKING | | |
| Time, minutes | 120 | 120 |
| Temperature, °C | 160 | 145 |
| Alkali consumption, kg EA/BDMT wood | 63 | 66 |
| COUNTERCURRENT COOKING | | |
| Time, minutes | 150 | 150 |
| Temperature, °C | 160 | 155 |
| Alkali consumption, kg EA/BDMT wood | 15 | 10 |
| RESULTS | | |
| H-Factor | 1850 | 874 |
| Alkali consumption, kg EA/BDMT wood | 177 | 168 |

METHOD FOR THE CONTINUOUS COOKING OF PULP

This application is a continuation-in-part of application Ser. No. 08/822,042, filed on Feb. 24, 1997 now abandoned, which is a continuation-in-part application of U.S. patent application Ser. No. 08/801,524, filed Feb. 18, 1997, now U.S. Pat. No. 5,824,187, issued Oct. 20, 1998.

TECHNICAL FIELD

The present invention relates to a novel method for producing pulp, preferably sulphate cellulose, with the aid of a continuous cooking process.

STATE OF THE ART

Environmental demands has forced our industry to develop improved cooking and bleaching methods. One recent brake through within the field of cooking is ITC™, which was developed by us in 1992–1993. ITC™ is described in WO-9411566, which shows that very good results concerning how pulp quality could be achieved when using ITC™, which mainly is based on using almost the same temperature (relatively low compared to prior art) in all cooking zones in combination with moderate alkaline levels. The ITC™-concept does not merely relate to the equalization of temperatures between different cooking zones, but a considerable contribution of the ITC™-concept relates to enabling an equalized alkaline profile also in the lower part of the counter-current cooking zone.

Moreover, it is known that impregnation with the aid of black liquor can improve the strength properties of the fibers in the pulp produced. The aim of the impregnation is, in the first place, to thoroughly soak each chip so that it becomes susceptible, by penetration and diffusion, to the active cooking chemicals which, in the context of sulphate cellulose, principally consist of sodium hydroxide and sodium sulphide.

If, as is customary according to prior art, a large proportion of white liquor is supplied in connection with the impregnation, there will exist no distinct border between impregnation and cooking. This leads to difficulties in optimizing the conditions in the transfer zone between impregnation and cooking.

Now it has been found that surprisingly good results can be achieved when:

1. Keeping a low temperature but a high alkali content in the beginning of a concurrent cooking zone of the digester;
2. Withdrawing a substantial part of spent liquor having past at least said concurrent cooking zone and having a high alkaline content; and
3. Supplying a substantial portion of said withdrawn spent liquor having a relatively high amount rest-alkali, adjacent the beginning of an impregnation zone.

This leads to a reduced H-factor demand, reduced consumption of cooking chemicals and better heat-economy. On top of that the novel method leads to production of pulp having high quality and a very good bleachability, which means that bleach chemicals and methods can be chosen with a wider variety, than before for reaching desired quality targets (brightness, yield, tear-strength, viscosity, etc.) of a finally bleached pulp.

Furthermore we have found that these good results can also be achieved when moving in a direction opposite the general understanding of the ITC™-teaching, in connection with digesters having a counter-current cooking zone. Contrary to try to maintain almost the same temperature levels in the different cooking zones we have found that if using a digester having both a concurrent and a counter-current cooking zone big advantages may be gained if the following basic steps are used:

1. Keeping a low temperature but a high alkali content in the concurrent zone of the digester,
2. Keeping a higher temperature but a lower alkali content in the counter-current zone
3. Withdrawing a substantial part of spent liquor having past at least one digesting zone and having a high alkaline content, and
4. Preferably supplying almost all of said withdrawn spent liquor having a relatively high amount rest-alkali, adjacent the beginning of the impregnation zone.

Also in connection with digesters of the one-vessel type (without separate impregnation vessel) surprisingly good results are achieved when the basic principles of the invention is used.

Moreover preliminary results indicate that the preferred manner of using the invention may be somewhat modified also in other respects but still achieving very good result, e.g. excluding the counter-current cooking zone.

Additionally, expensive equipment might be eliminated, e.g. strainers in the impregnation vessel, hanging central pipes, etc., making an installation much simpler and considerably less expensive.

DESCRIPTION OF THE FIGURES

In that which follows, reference will be made to the enclosed figures in which:

FIG. 6 shows which conditions were used in the laboratory for one of the ITC-references and one of the cooks according to the invention (so called modified ITC).

DETAILED DESCRIPTION

Figure 1:
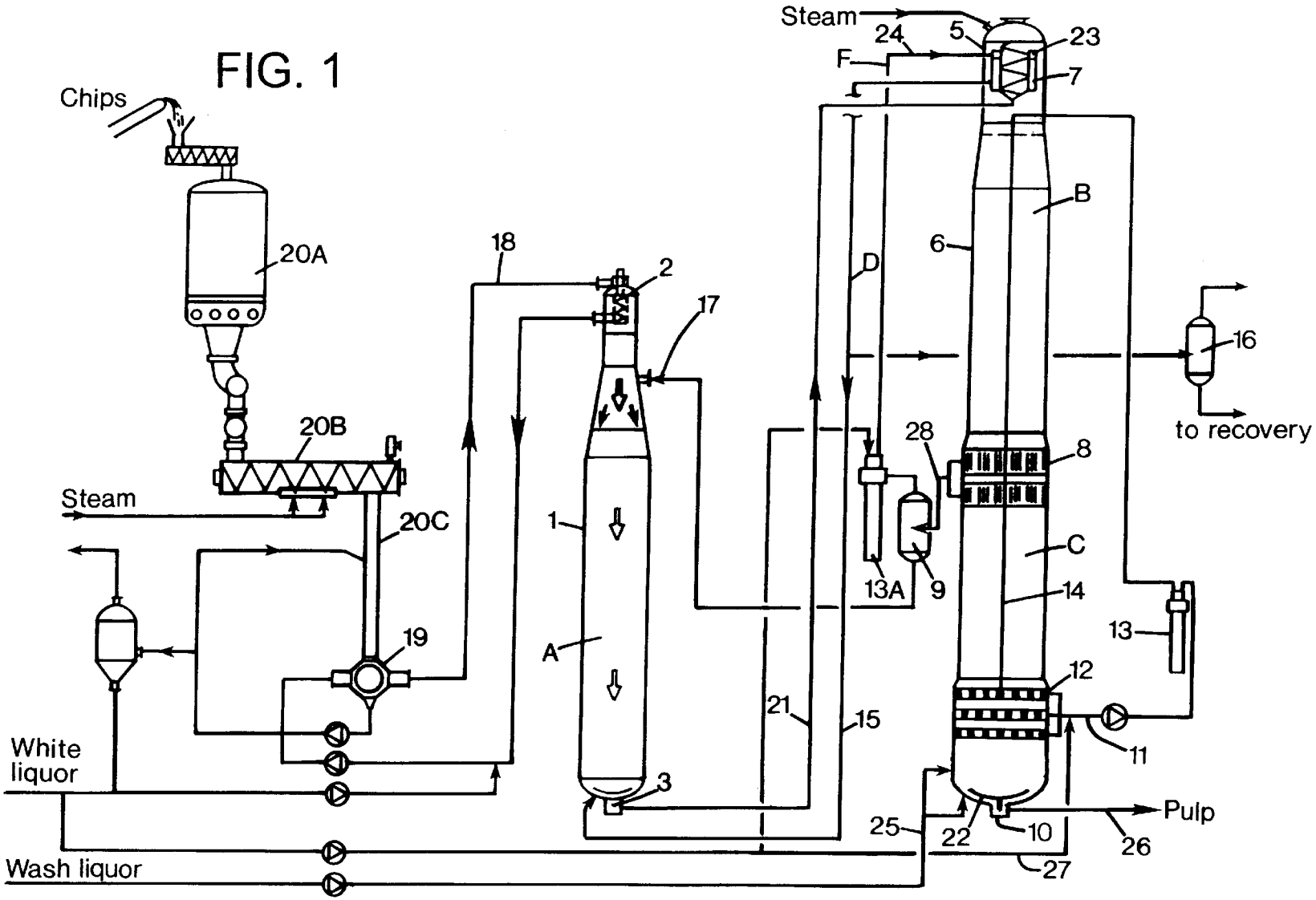
FIG. 1 shows a preferred embodiment of a continuous two vessel steam/liquid-phase digester arrangement according to the invention.

FIG. 1 shows a preferred embodiment of a two vessel steam/liquid-phase digester for producing chemical pulp according to the invention. The main components of the digesting system consist of an impregnation vessel 1 and a steam/liquid-phase digester 6.

The impregnation vessel 1, which normally is totally liquid filled, possesses a feeding-in device 2 at the top, which feeding-in device is of a conventional type, i.e. a top separator with screw-feed device which feeds the chips in a downward direction at the same time as transport liquid is drawn off. At the bottom, the impregnation vessel possesses a feeding-out device 3 comprising a bottom scraper. In addition to this, there is a conduit 17 for adding hot black liquor. As seen, the black liquor is preferably supplied at the top of the impregnation vessel. In contrast to conventional impregnation vessels no draw-off screen is located on the impregnation vessel. The chips are fed from the chip bin 20A, through the steaming vessel 20B and the chip chute 20C. Finally a feeding device, preferably a high-pressure feeder 19, feeds the chips via a conduit 18 to the top of the impregnation vessel 1. The feeder 19 is arranged in a known manner to a chute, and is connected to necessary liquid circulations and replenishment.

A conduit 21 for transporting chips leads from the bottom of the impregnation vessel 1 up to the top 5 of the digester 6 having a steam space, wherein the liquid level being indicated by means of a broken line. A supply line for steam at the top provides for heating of the steam space. Conduit 21 opens out at the bottom of a top separator 7 which feeds by means of a screw in an upwardly moving direction. The screen of the separator is used to draw off the liquid D (which is then returned in line 15) together with which the chips are transported up to the top. At the upper edge of the screen (over which edge the chips tumble out), there is arranged an integrated annular ring 23. The annular ring 23 is connected to a conduit 24 which(preferably via a heat-exchanger 13A) leads to a white-liquor container (not shown). A screen girdle section 8 is arranged in conjunction with a step-out approximately in the middle of the digester 6. Draw-off from this screen girdle section 8 can be conducted directly via conduit 17 to the impregnation vessel 1. Preferably, however, the black liquor is drawn off via conduit 28 to a first flash cyclone 9.

At the bottom 10 of the digester, there is a feeding-out device including one scraping element 22.

According to a preferred alternative, "cold-blow" is carried out, the temperature of the pulp being cooled down at the bottom of the digester with the aid of relatively cold (preferably 70–80° C.) liquid (wash liquid) which is added by means of the scraping element 22 and/or other liquid-adding devices 25 (appropriately annular pipes) at the bottom, and then subsequently conducted upwards in counter-current. With the aim of being able to produce high-quality pulp having a low and equal kappa number it is essential to distribute chemicals and heat evenly across the digester, so that all fibers in the column are treated under the same conditions.

This is achieved by means of a lower circulation 11, 12, 13, 14, a so-called ITC™ circulation. This lower circulation consists of a screen girdle sections 12 (in the shown embodiment consisting of three rows) which is arranged at sufficient height above the lower liquid-addition point 22 and/or 25 to permit the attainment of a desired flow from the latter liquid-addition point towards the screen section 12. The draw-off from the said screen girdles 12, is recirculated (for displacing black liquor in counter-current to the draw-off screen 8) into the digester with the aid of a central pipe 14 (or alternately a stand pipe from the bottom of the digester) which opens out approximately on a level with the said screen girdle section 12. A heat exchanger 13 for temperature regulation (raising the temperature of the re-introduced liquid) and a pump are also located in the conduit 11 which connects the screen girdle 12 with the pipe 14.

The recirculation loop 11 is also connected via a branch conduit 27 to the white liquor supply so that fresh alkali can be supplied and, in the form of counter-current cooking, further reducing the kappa number. The digester construction described is notable for the lack of a plurality of central pipes arranged from above and hanging downwards, as well as of feed pipes connected to them and of other necessary parts for the circulations.

A preferred installation according to the invention functions as follows. The chips are fed in a conventional manner into a chip bin 20A, subsequently steamed 20B and thereafter into a chute 20C. A high-pressure feeder 19 (which in a known manner is supplied with a minor amount of white liquor (~5% of the total amount) in order to lubricate it), with the aid of which the chips are fed into conduit 18 together with transport liquid. The slurry of chips and liquid which is fed to the top of the impregnation vessel in this way have a temperature of about 110–120° C. on entry to the impregnation vessel (excluding recirculated transport liquor).

In addition to the actual fibers in the wood, the latter also conveys its own moisture (the wood moisture), which normally constitutes about 50% of the original weight, to the impregnation vessel. Over and above this, some condense is present from the steaming, i.e. at least a part of the steam (principally low-pressure steam) which was supplied to the steaming vessel 20B is cooled down to such a low level that it condenses and is then recovered as liquid together with the wood and the transport liquid.

In the top of the impregnation vessel there is a screw feeder 2 which pushes chips from above and downwards. No liquid is recirculated within the impregnation vessel, as is customary. Instead liquid from after the first flash 9 is supplied.

The chips which are fed out from the bottom of the top screen 2 then move slowly downwards in a plug flow through the impregnation vessel 1 in a liquid/wood ratio between 2/1–10/1 preferably between 3/1–8/1, more preferred of about 4/1–6/1. Hot black liquor, which is drawn off from the first flash 9, is added, via conduit 17, in the top of the impregnation vessel 1. The high temperature of the black liquor (100–160° C.), preferably exceeding 130° C., more preferred between 130–160° C., ensures rapid heating of the chips. In addition, the relatively high pH, exceeding pH 10, of the black liquor neutralizes acidic groups in the wood and also any acidic condensate accompanying the chips, thereby, i.a. counteracting the formation of encrustation, so-called scaling.

An additional advantage of the method is that the black liquor supplied into the impregnation vessel has a high content of rest alkali, (EA as NaOH), at least 13 g/l, preferably about or above 16 g/l and more preferred between 13–30 g/l in the top of the impregnation vessel. This alkali mainly comes from the black liquor due to the high amount of alkali in the concurrent zone of the digester. Furthermore the strength properties of the fibers are positively affected by the impregnation because the high amount of sulphide. The major portion of black liquor is directly (or via one flash) fed to the impregnation vessel 1. A minor amount of the black liquor may be used for transferring the chips from the HP-feeder to the inlet of the impregnation vessel.

This minor flow then has to be cooled (not shown) before it is entered into the feeder. The two flows of black liquor are preferably used to regulate the temperature within the impregnation zone, which never must exceed 140° C. The total supply of black liquor to the impregnation vessel exceeds 80% of the amount drawn off from the draw-off strainers 8, preferably more than 90% and optimally about 100% of the total flow, which normally is about 8–12 $m^3$/ADT.

The chips, which have been thoroughly impregnated and partially delignified in the impregnation vessel, are fed to the top of the digester 6 and conveyed into the upwardly-feeding top separator 7. The chips are thus fed upwards through the screen, meanwhile free transport liquid is withdrawn outwardly through the screen and finally the chips fall out over the edge of the screen down through the steam space. Before or during their free fall, the chips pieces are drained with cooking liquor which is supplied by means of the top separator 7. The white liquor is preferably heated by means of a heat exchanger 13A which preferably is supplied with heat steam from flash tank 9.

The quantity of white liquor which is added here depends on how much white liquor possibly is added else where, but the total amount corresponds to the quantity of white liquor which is required for achieving desired delignification of the wood. Preferably a major part of it is added here, i.e. more than 60%, which also improves the diffusion velocity, since it increases in relation to the concentration difference (chip-surrounding liquid). The thoroughly impregnated chips extra rapidly assimilate the active cooking chemicals by diffusion, since the concentration of alkali (EA as NaOH) is relatively high, at least 20 g/l, preferably between 30 g/l and 50 g/l and more preferred about 40 g/l.

The chips then move down in the concurrent through the digester 6 at a relatively low cooking temperature, i.e. between 130–160° C., preferably about 140–150° C. The major part of the delignification takes place in the first concurrent cooking zone.

The retention time in this first cooking zone should be at least 20 minutes, preferably at least 30 minutes and more preferred at least 40 minutes. The liquid-wood ratio should be at lest 2/1 and should be below 7/1, preferably in the range of 3/1–5.5/1, more preferred between 3.5/1 and 5/1. (The liquid wood-ratio in the counter-current cooking zone should be about the same as in the concurrent cooking zone.)

The cooking liquid mingled with released lignin, etc., is drawn off at the draw-off screen 8. As mentioned above liquid finally is also supplied in the lower part of the digester which moves in counter-current. It can be describes as the pipe 14 displacing it from the wood upwards towards the draw-off screen 8. This results, consequently, in the delignification being prolonged in the digester 6.

The temperature in this lower zone C is preferably higher than in the concurrent zone B, i.e. preferably exceeding 140° C., preferably about 145–165° C., in order to dissolve remaining lignin. The alkali content in the lowermost part of the countercurrent cooking zone should preferably be lower than in the beginning of the concurrent zone, above 5 g/l, but below 40 g/l. Preferably less than 30 g/l and more preferred between 10–20 g/l. In the preferred case, the aim is to have a temperature difference of about 10° C. between the cooking zones. Expediently, the lower circulation 11, 12, 13, 14 is charged with about 5–20%, preferably 10–15%, white liquor. The temperature of the liquid which is recirculated via the pipe 14 is regulated with the aid of a heat exchanger 13 so that the desired cooking temperature is obtained at the lowermost part of the counter-current cooking zone.

In the preferred case, "cold-blow" is used, with the temperature of the pulp in the outlet conduit 26 being less than 100° C. Accordingly, washing liquid having a low temperature, preferably about 70–80° C., is added in a known manner using the scraping element and an outer annular conduit 25 arranged at the bottom. This liquid consequently displaces the boiling hot liquor in the pulp upwards in counter-current and thereby imparts a temperature to the remaining pulp which can be cold-blown, i.e. depressurised and disintegrated without any real loss of strength.

From tests made in lab-scale, we have found indications that it is desired to keep the alkaline level at above at least 2 g/l, preferably above 4 g/l, in the impregnation vessel in connection with black liquor, which would normally correspond to a Ph of about 11. If not, it appears that dissolved lignin precipitate and even condense.

Figure 2:
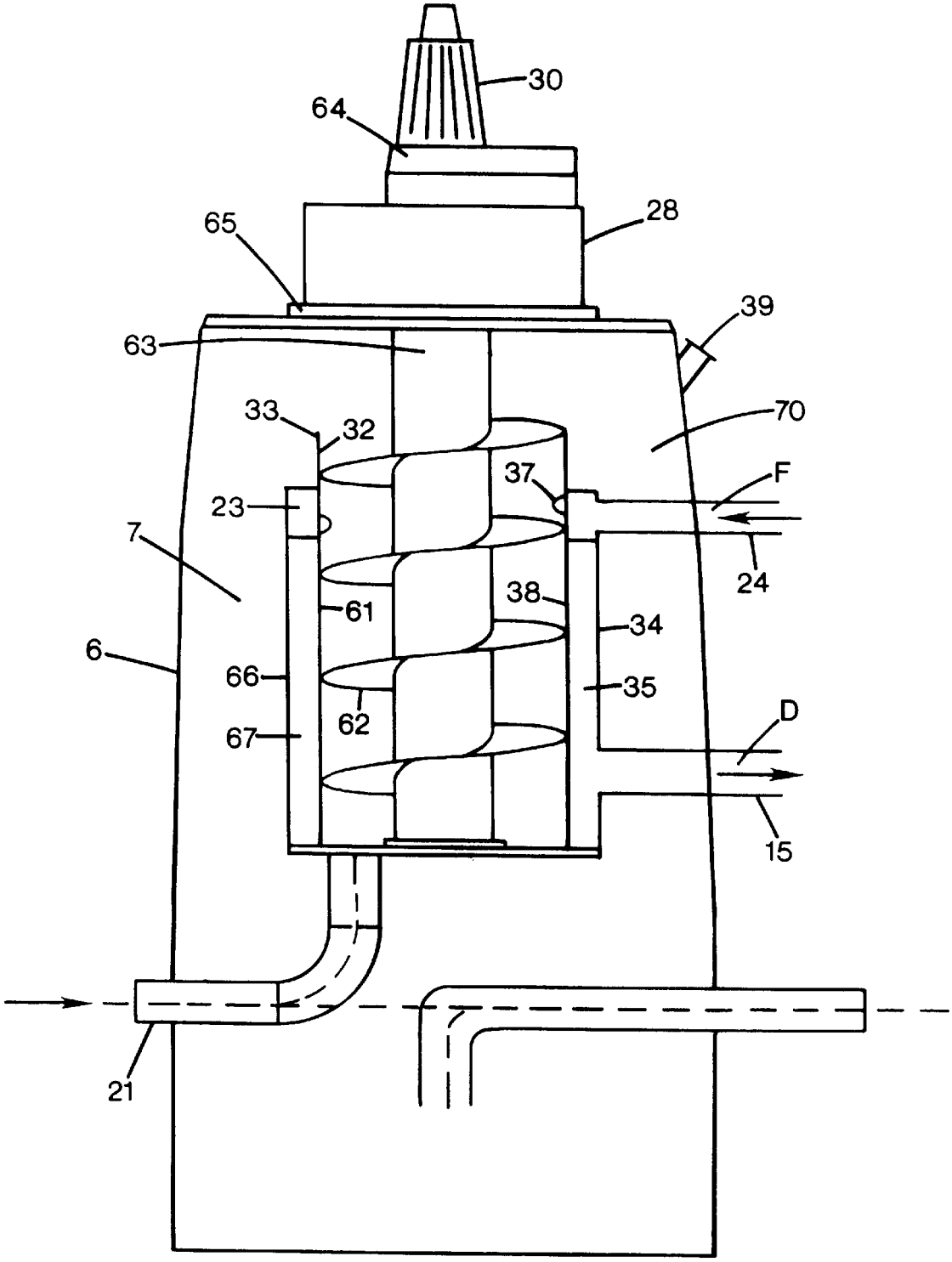
FIG. 2 shows a preferred top separator to be used in a steam/vapor-phase digester according to the invention.

In FIG. 2 there is shown a preferred embodiment of a separator to be used in connection with a steam/vapor phase digester, as described in FIG. 1. As is known per se it is preferred to have an upwardly feeding top separator for a steam/liquor-phase digester. The separator comprises a screen basket (61) in which a screw feeder (62) is positioned. The screw feeder is fixedly attached to a shaft (63) which at its upper end is fixedly attached to a drive unit (64). The drive unit (64) is attached to a plate (65) which is attached to the digester shell (6).

Circumjacent the screen basket (61) there is arranged a liquid collecting space (67), which is connected to the return pipe circulation (15). Above the liquid collecting space (67), also circumjacent the screen basket (61), there is arranged a liquid supply space (23) which is connected to a supply line (24). Between the outer peripheral wall of the liquid collecting space (66) and the liquid supply space (67) respectively, and the digester shell (6) at the top, there exist an annular space (70) which opens up down into the upper part of the digester (6). The functioning of the top separator is as follows.

The thoroughly heated and impregnated chips are transferred by means of the supply line (21) into the bottom portion of the screen basket (61). Here the screw feeder (62) moves the chips upwardly at the same time as liquid is separated from the chips, by being withdrawn outwardly through the screen basket (61) and further out of the digester through return line (15). More and more liquid will be withdrawn from the chips during their transport within the screen basket (61). Eventually chips will reach the level of the supply space (23). Here the desired amount of cooking liquor is added, having a temperature and effective alkaline content in accordance with the invention.

In order to eliminate the risk of back flowing of supplied liquid from the supply space (23) into the withdrawal space (67), a minor amount of free liquid (about 0.5 $m^3$/ADT) should be left together with the chips, which free liquid will then be mixed with the supplied cooking liquor. At the top of the screen basket the chips and the cooking liquor will flow over the upper edge thereof and fall into the steam vapor space (70) and further on to the top of the chips pile within the digester, where the concurrent cooking zone (B) starts.

Figure 3:
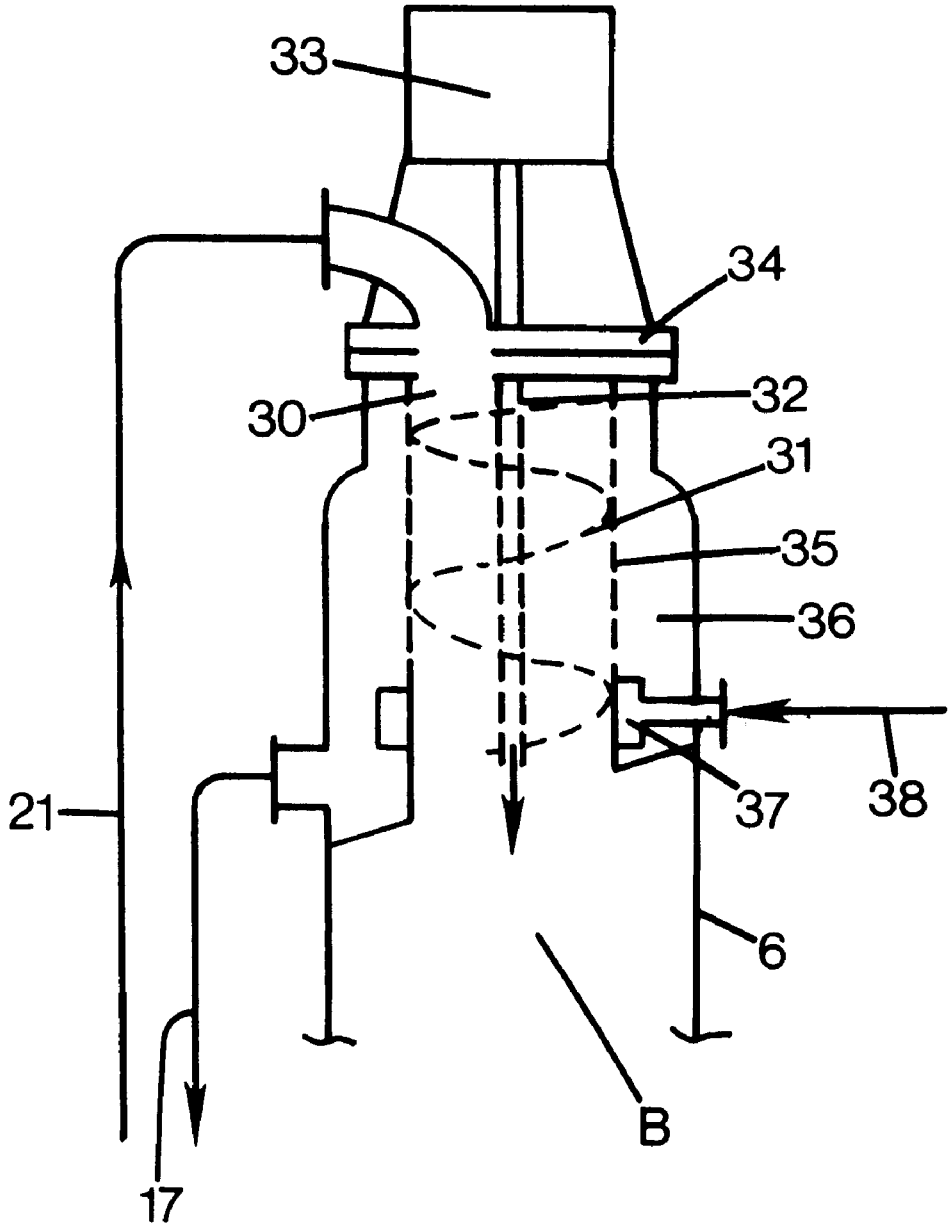
FIG. 3 shows a preferred top separator to be used in an hydraulic digester according to the invention.

In FIG. 3 there is shown a preferred embodiment of a separator to be used together with a hydraulic digester. Only a part of the top of the digester (6) is shown. The slurred fibre material (pre-impregnated or not) is transferred to the top of the digester by means of a transfer line (21) and enters an in-let space (30) of a screw-feeder (31). The screw-feeder (31) is attached to a shaft (32) connected to a drive-unit (33) which is attached to a mounting-plate (34) on the top of the digester shell (6). The drive-shaft (32) is rotated in a direction so as to force the screw to feed in a down-ward direction.

A cylindrical screen-basket (35) surrounds the screw-feeder (31). The screen-basket (35) is arranged within the digester shell (6) so as to form a liquid collecting space (36) between the digester shell and the outer surface of the screen-basket (35). The liquid collecting space (36), which preferably is annular, communicates with a conduit (17) for withdrawing liquid from the liquid collecting space (36), which in turn is replenished by liquid from the slurry within the screen basket (35). The major part of the free liquid within the slurry entering the screen basket is withdrawn into the liquid collecting space (36), but a small portion of free liquid, at least about 0.5 $m^3$/ADT should not be withdrawn from the slurry.

Adjacent the outlet end of the screen basket (35) there is arranged a liquid supply device (37), preferably comprising an annular distribution ring which opens up into the chips pile for supply of liquid into the fibre material moving down into the digester (6). The liquid supply device (37) is replenished by means of line 38 wherein a desired liquid is supplied. If it is a two-vessel hydraulic digester system the liquid supplied through the liquid supply device (37) would be hot cooking liquor having a relatively high amount of effective alkaline, in order to provide for the possibility of establishing a concurrent cooking zone (B) having a desired temperature of about 145–150° C., and a desired content of effective alkaline, e.g. about 45 g/l. The invention is also applicable in connection with one vessel digesters of both kinds, as will be exemplified below.

A major advantage with both kinds of the shown separation devices is that they provide for establishing a distinguished change of zones (they enable almost a total exchange of free liquid at this point), which means that for a two vessel system the desired conditions in the beginning of the concurrent zone (B) can easily be established.

Figure 4:
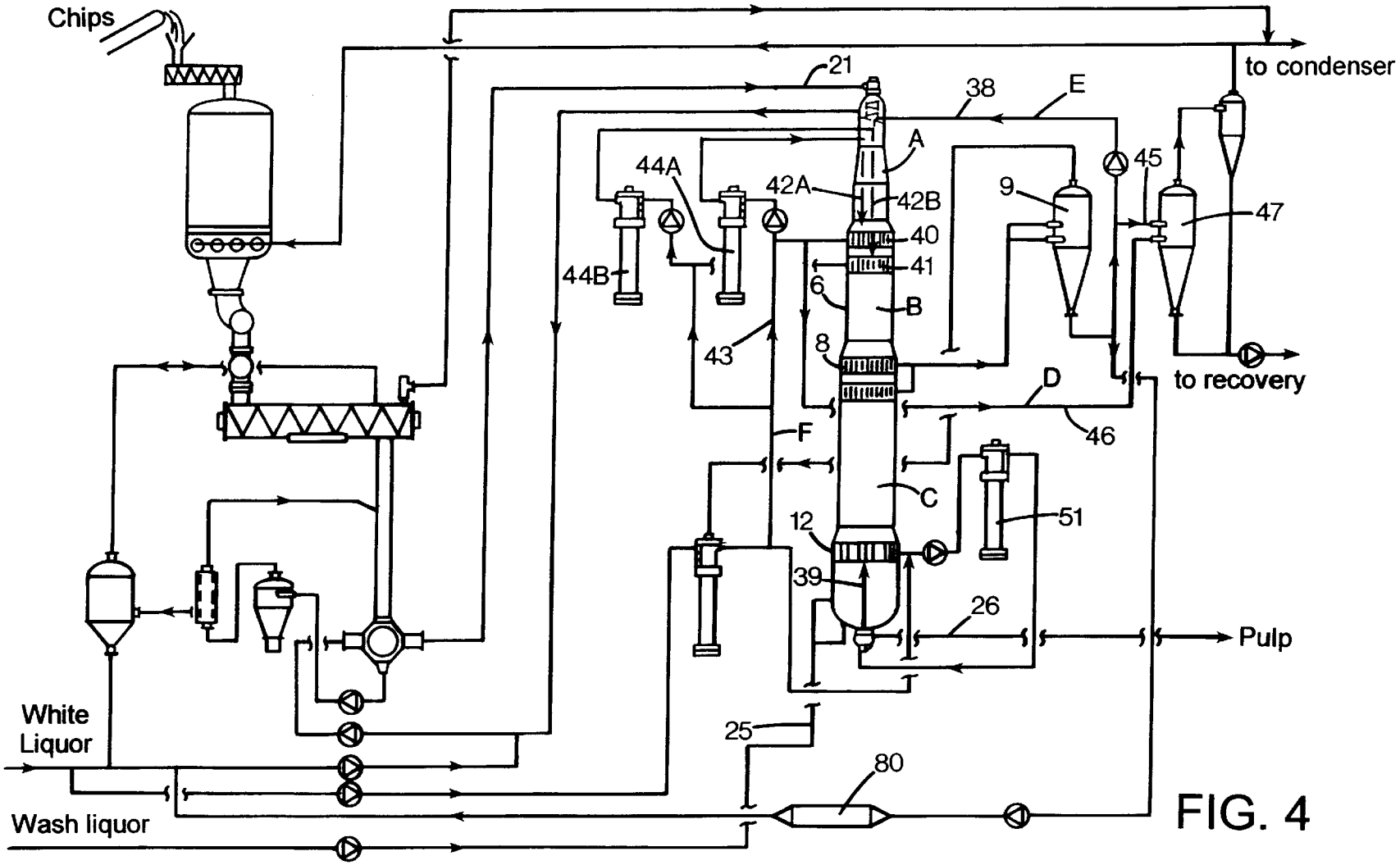
FIG. 4 shows a preferred embodiment of a an hydraulic digester according to the invention.

In FIG. 4 it is shown a preferred embodiment for applying the invention to a one-vessel hydraulic digester. The same kind of basic equipment before and in connection with the HP-feeder as shown in FIG. 1 is used, which therefore is not described in detail. Further the basically same kind of top separator arrangement as described in FIG. 3 is mounted at the top of the digester 6. In the middle part of the digester withdrawal strainers (8) are arranged. The lowermost part of the digester is in principle similar to the one shown in FIG. 1, with a supply line (25) for wash liquid and a blow line (26) for the digested pulp. A short distance above the bottom there is positioned a strainer arrangement (12), for withdrawing liquid, which is heated and to which some white liquor, preferably about 10% of the total amount, is added before it is recirculated by means of a stand pipe (39), which opens up at about the same level as the lowermost strainer girdle (12).

In the upper part of the digester there are arranged two further strainer sets (40, 41). The upper strainer (40) is arranged for withdrawing liquid which has passed the impregnation zone (A). Some of the withdrawn liquid D is taken out via line 46 to a flash tank 47. The other part of the withdrawn liquid is recirculated for re-introducing liquid withdrawn by means of a central pipe (42A) which opens up at a level adjacent the strainer (40). Before the liquor withdrawn from the strainer (40) is re-introduced white liquor can be added thereto by means of a supply-line (43A) and thereafter the liquid is heated to the desired temperature by means of a heat exchanger (44A).

The second strainer (41), which is positioned intermediate the upper strainer (40) and the withdrawal strainer (8) is a also part of a re-circulation. The withdrawn liquid is recirculated for re-introducing it by means of a central pipe (42B) which opens up at a level adjacent the strainer (41). Before the liquor withdrawn from the strainer (41) is re-introduced the main part white liquor is added thereto by means of a supply-line (43B) and thereafter the liquid is heated to the desired temperature by means of a heat exchanger (44B).

The digesting process within a digester shown in FIG. 4 is as follows. The slurry of chips and transport liquid is transferred, e.g. by means of high pressure feeder, within the feeding line (21) to the top of the digester where it is introduced into the top of the screen basket (35) of the separator, wherein the major part of transport liquid is separated from the chips. At the lower end 37 of the separator impregnation liquor E is supplied by means of line 38. The impregnation liquor is hot black liquor which is taken from the withdrawal screen (8) via a flash tank 9 by means of the supply conduit (38).

If all the desired amount cannot be withdrawn via line 46 to flash tank 47 there is provided for the possibility to also withdraw from the outlet of the first flash tank 9 via line 45. A minor amount of the black liquor withdrawn from flash tank 9 may be used for transferring the chips from the HP-feeder to the inlet of the digester 6. This minor flow then has to be cooled in a cooler 80 before it is entered into the feeder. The two flows of black liquor are preferably used to regulate the temperature within the impregnation zone, which never must exceed 140° C.

The amount of effective alkaline in the supplied black liquor E is relatively high, at least 13 g/l, preferably about 20 g/l, which provides for the impregnation zone (A) to be established without any substantial additional supply of white liquor at this position. The chips is then impregnated and heated when moving down towards the upper screen (40), where spent liquor (D) is withdrawn and transferred by means of a conduit (46) to a flash tank (47).

The chips are heated and alkali is introduced by means of the above described cooking circulations (40,42A,43A, 44A;41,42B,43B,44B) in order to obtain desired cooking conditions. In a preferred mode the temperature at the beginning of the concurrent zone is about 145–160° C. for soft wood and about 140–155° C. for hard wood and an alkaline content of about 30–50 g/l. Thanks to the exothermic reaction of the chemicals the temperature is slightly further increased when the fibre material is moving downwardly in the concurrent cooking zone (B).

Liquid having a relatively high content of effective alkaline is withdrawn at the strainers (8) positioned adjacent the middle. The alkaline content of this withdrawn spent liquor (E) would normally exceed 15 g/l.

Also liquor from the counter-current zone (C) is withdrawn at this withdrawal strainer (8), since the liquor being introduced by means of the stand pipe (39) moves in counter-current upwardly finally reaching these strainers (8).

In the counter-current zone (C), preferably, a higher temperature is maintained than in the concurrent zone (B). This is achieved by means of heating the liquid drawn from the lower withdrawal strainer (12), in a heat exchanger (51) before introducing it through the stand pipe (39). In the preferred case also a minor amount, about 10–15% of the total amount, of white liquor is added in this recirculation line, to achieve the desired alkali concentration in the counter-current cooking zone (C).

In the usual manner the pulp is cooled, by means of wash liquid (25) being supplied at the bottom of the digester, which wash liquid moves in counter-current upwardly and subsequently is withdrawn in strainer (12). The cooled finally digested pulp, is then taken out of the digester into the blow-line (26).

As already mentioned, pulp produced in this manner will have higher quality and better bleachability then pulp produced with known methods. In lab-scale tests we have found that about 10 kg of active chlorine can be saved for reaching full brightness (about 90% ISO), compared to a conventionally cooked pulp.

Figure 5:
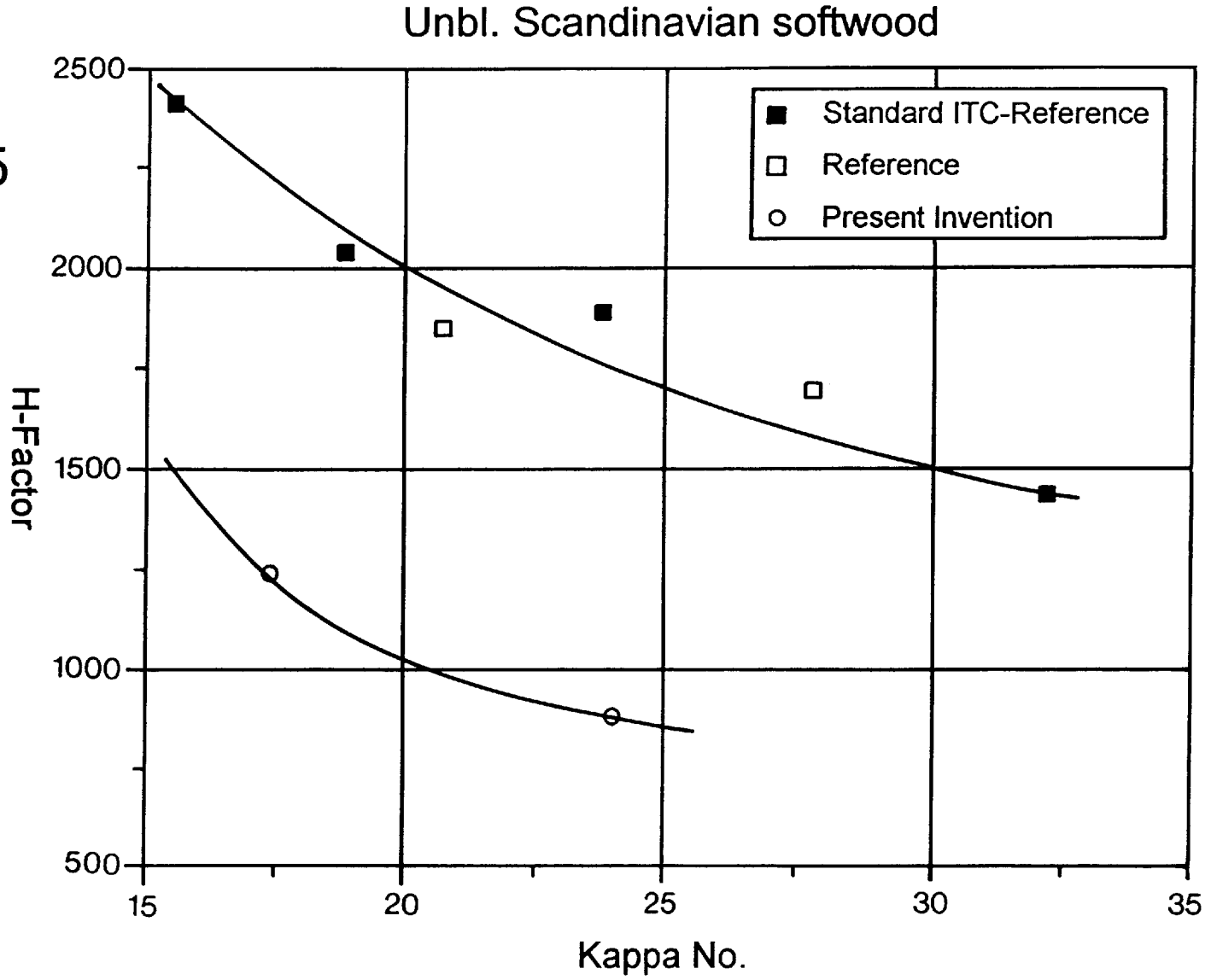
FIG. 5 shows a diagram presenting the advantages related to the H-factor when using the invention.

In FIG. 5 there is shown a diagram comparing the H-factor for pulp produced according to conventional ITC™-cooking and the invention. The H-factor is a function of time and temperature in relation to the delignification process (degree of delignification) during cooking. The H-factor is used to control the delignification process of a digester, i.e. maintaining a certain H-factor principally leads to the same Kappa number of the produced pulp (remaining lignin content of the fibre material) independent of temperature variations during the cooking.

In FIG. 5 it is shown that the H-factor for pulp produced according to the invention is extremely much lower (about 40–50% lower) compared to pulp produced according to ITC™. This means that much lower temperatures may be used for the same retention time in order to reach a certain degree of delignification (Kappa number) and/or that smaller vessels for the cooking within a continuous digester can be used and/or that a lower Kappa number may be achieved with the same kind of basic equipment and/or that higher rate of production can be obtained.

The lower H-factor demand is achieved by a high alkali concentration and a low cooking temperature in the concurrent cooking zone, which is shown in FIG. 6 which presents one reference ITC-cook (ITC 1770) and one cook according to the invention (modified ITC* 1763). As shown the temperature in the counter-current cooking zone, according to the invention, is higher than in the concurrent zone but still lower than the temperature in the counter-current zone in the ITC-reference.

The invention is not limited to that which has been shown above but can be varied within the scope of the subsequent patent claims. Thus, instead of the shown separator used with the hydraulic digester many alternatives may be used, e.g. in stead of an annular supply arrangement a central pipe (as shown in WO-9615313) for supply of liquid at distance downstream of the separator device within chip pile adjacent the top of the digester.

Moreover there are many ways of optimizing the conditions even further, e.g. new on-line measuring systems (for example using NIR-spectroscopy) provide for the possibility of exactly measuring specific contents of the fibre material and the liquids entering the digesting system, which will make it feasible to more precisely determine and control the supply/addition of specific fluids/chemicals and also their withdrawal in order to establish optimized conditions. Different kind of additives can be very beneficial to use, especially for example poly-sulphide which has a better effect in a low temperature environment than in high temperatures. Also AQ (Anthraquinone) would be very beneficial since it combines very well with high alkaline environments.

Furthermore, there are a multiplicity of alternatives for uniformly drenching the chips with white liquor at the top of the digester. For example, a centrally arranged inlet (as described in WO-having a spreading device can be contrived, which device, in a known way, provides a mushroom-like film of liquid, as can a centrally arranged showering element or an annular pipe with slots, etc.

In addition, it will be evident to a person skilled in the art that the number of screen girdles shown is in no way limiting for the invention but, instead, the number can be varied in dependence on different requirements. It is likewise obvious that the invention is in no way limited to a certain screen configuration and it is understood that bar screens can be exchanged by, for example, such as screens having slots cut out of sheet metal. Also in some installations moveable screens are preferred.

Furthermore, it will be evident to the person skilled in the art that, in order to amplify the heat economy, measures can be taken which decrease heat losses from the digester, such as, for example, insulation of the digester shell and/or maximization of the volume in relation to the outwardly exposed surface, i.e. increasing the cross-sectional area.

The shown system in front of the digester is in no way limiting to the invention, e.g. it is possible to exclude the steaming vessel 20 and have a direct connection between the chip bin (for example, a partly filled atmospheric vessel) and the chip chute. Furthermore, other kind of feeding systems than an HP-feeder may be used, e.g. DISCFLO™-pumps).

In order to improve the distribution of the white liquor added at the top, it is possible to install a so called "quench circulation" which would recirculate a desired amount of liquid from below the top screen 7 back to the annular pipe 23. For this purpose ordinary screens is not a requirement. Finally, it should be understood that the basic principle of the invention can be applied also in combination with a circulation (strainer and piping) on the impregnation vessel, even if this, of course, reduces the cost advantage.

Moreover the invention can be used in digesters not having a distinguished counter-current cooking zone. For example in some retrof its of digesters it may be advantageous to position the withdrawal strainers close to the bottom. Also in connection with heavily overloaded digesters that can not be provided with a sufficient supply of wash liquor enabling a sufficient up-flow for counter-current cooking, the invention can be used by supplying wash liquid, as customary, in the bottom and preferably also by means of central pipe displacing liquid radially to a screen section.

Further, it should be understood that some advantages of our invention are also achieved in a two zones digester, even if almost the same temperature is maintained in the concurrent and the counter-current cooking zones.

We claim:

1. A method for continuously producing pulp, comprising:

providing a finely divided fiber material, a transportation liquid and an impregnation zone, the impregnation zone maintaining a cooking pressure;

providing a digester having a top portion and a bottom portion and at least one strainer girdle disposed therein, the digester being adapted to facilitate a cooking reaction, the digester having a concurrent cooking zone at the top portion of the digester, the concurrent cooking zone having a beginning and an end;

providing the digester with a total amount of cooking liquor;

mixing the finely divided fiber material with the transportation liquid to form a slurry;

while mixing the finely divided fiber material, transporting the slurry to the impregnation zone;

while transporting the slurry, prevailing the cooking pressure in the impregnation zone;

transferring a hot black liquor to the impregnation zone;

while transferring the hot black liquor, heating the fiber material disposed in the impregnation zone to a first temperature that is below 140 degrees Celsius and thoroughly impregnating the fiber material by exposing the fiber material to the hot black liquor;

while heating the fiber material, passing the fiber material through the impregnation zone in a direction that is concurrent with a flow direction of the hot black liquor;

while passing the fiber material through the impregnation zone, separating and withdrawing a substantial portion of the transportation liquid from the slurry in the digester;

while separating and withdrawing the transportation liquid, transferring the heated and thoroughly impregnated fiber material from the impregnation zone to the concurrent cooking zone;

while transferring the heated and impregnated fiber material, supplying at least 60% of the total amount of the cooking liquor to the concurrent cooking zone of the digester;

while supplying the cooking liquor, obtaining a first level of effective alkaline that is at least 35 grams per liter at the beginning of the concurrent cooking zone;

while obtaining the first level of effective alkaline, withdrawing spent liquor, that have passed through the concurrent cooking zone of the digester, at the strainer girdle of the digester, the spent liquor having an effective alkali level of at least 13 grams per liter;

removing pulp from the bottom portion of the digester; and maintaining a second temperature in the beginning of the concurrent cooking zone that is higher than the first temperature of the impregnation zone, the second temperature being below 160 degrees Celsius.

2. The method according to claim 1 wherein step of providing a finely divided fiber material includes the step of providing wood chips.

3. The method according to claim 1 wherein more than 70% of the total amount of cooking liquor is supplied to the top portion of the digester.

4. The method according to claim 1 wherein the second temperature is below 155 degrees Celsius.

5. The method according to claim 1 wherein the second temperature is between 140 degrees Celsius and 150 degrees Celsius.

6. The method according to claim 1 wherein the step of withdrawing spent liquor includes the step of withdrawing spent liquor having an effective alkaline level that is at least 16 grams per liter.

7. The method according to claim 1 wherein the step of withdrawing spent liquor includes the step of withdrawing spent liquor having an effective alkaline level that is at least 18 grams per liter.

8. The method according to claim 1 wherein the step of withdrawing spent liquor includes the step of withdrawing spent liquor having an effective alkaline level that is about 20 grams per liter.

9. The method according to claim 1 wherein the step of obtaining the effective alkaline level includes the step of obtaining an effective alkaline level that exceeds 40 grams per liter.

10. The method according to claim 9 wherein the step of obtaining the effective alkaline level includes the step of obtaining an effective alkaline level that is between 45 grams per liter and 55 grams per liter.

11. The method according to claim 1 wherein the step of providing the impregnation zone includes providing the impregnation zone with an upstream end and the step of withdrawing spent liquor from the digester includes the step of supplying a substantial portion of the spent liquor to the upstream end of the impregnation zone.

12. The method according to claim 11 wherein the step of withdrawing spent liquor includes the step of supplying the spent liquor to the impregnation zone when a substantial portion of the spent liquor has a temperature exceeding 100 degrees Celsius.

13. The method according to claim 12 wherein the step of withdrawing spent liquor includes the step of supplying the spent liquor to the impregnation zone when the substantial portion of the spent liquor has a temperature of between 120 degrees Celsius and 160 degrees Celsius.

14. The method according to claim 13 wherein the step of withdrawing spent liquor includes the step of supplying the spent liquor to the impregnation zone when the substantial portion of the spent liquor has a temperature of between 130 degrees Celsius and 150 degrees Celsius.

15. The method according to claim 11 wherein the step of supplying spent liquor comprises the steps of passing the spent liquor through a first flash tank and supplying the spent liquor to the impregnation zone.

16. The method according to claim 1 wherein the method comprises providing a steam phased digester having a counter-current cooking zone including a lowermost portion having a third temperature that is higher than the second temperature at the beginning of the concurrent cooking zone of the digester.

17. The method according to claim 16 wherein the third temperature is at least 5 degrees Celsius higher than the second temperature.

18. The method according to claim 16 wherein the third temperature is between 5 degrees Celsius and 20 degrees Celsius higher than the second temperature.

19. The method according to claim 18 wherein the third temperature is between 7 degrees Celsius and 15 degrees Celsius higher than the second temperature.

20. The method according to claim 16 wherein the method further includes the step of supplying a certain amount of effective alkaline to the digester adjacent the bottom portion thereof and obtaining a second level of effective alkaline in the lowermost portion of the counter-current zone of the digester, the second level of effective alkaline is lower than the first level of effective alkaline so that a difference between the second level and the first level of effective alkaline is at least 20 grams per liter.

21. The method according to claim 20 wherein the difference is at least 25 grams per liter.

22. The method according to claim 20 wherein the difference is between 30 and 50 grams per liter.

23. The method according to claim 1 wherein the method further includes the step of providing an impregnation vessel and the step of withdrawing spent liquor includes the step of supplying at least 70% of the spent liquor withdrawn to an inlet of the impregnation vessel.

24. The method according to claim 23 wherein the step of supplying includes the step of supplying at least 80% of the spent liquor withdrawn to the impregnation vessel.

25. The method according to claim 23 wherein the step of supplying includes the step of supplying between 90% and 100% of the spent liquor withdrawn to the impregnation vessel.

26. The method according to claim 23 wherein the method further comprises conveying black liquor directly to a recovery system.

27. The method according to claim 1 wherein the step of providing a digester comprises the steps of providing a steam/vapor-phase digester having a top separator including a screw that feeds upwardly and the separator is adapted to both separate the spent liquor and to supply the cooking liquor.

28. A method for continuously producing pulp, comprising:

providing wood chips, a transportation liquid and an impregnation zone, the impregnation zone maintaining a cooking pressure;

providing a digester having a top portion and a bottom portion and at least one strainer girdle disposed therein, the digester being adapted to facilitate a cooking reaction, the digester having a concurrent cooking zone at the top portion of the digester, the concurrent cooking zone having a beginning and an end, the concurrent cooking zone having a lowermost portion having a zone temperature;

providing a flash tank in fluid communication with the impregnation zone;

mixing the wood chips with the transportation liquid to form a slurry;

while mixing the finely divided fiber material, transporting the slurry to the impregnation zone;

while transporting the slurry, prevailing the cooking pressure in the impregnation zone;

transferring a hot black liquor to the impregnation zone;

while transferring the hot black liquor, heating the fiber material disposed in the impregnation zone to a first temperature that is below 140 degrees Celsius and thoroughly impregnating the fiber material by exposing the fiber material to the hot black liquor;

while heating the fiber material, passing the fiber material through the impregnation zone in a direction that is concurrent with a flow direction of the hot black liquor;

while passing the fiber material through the impregnation zone, separating and withdrawing a substantial portion of the transportation liquid from the slurry in the digester;

while separating and withdrawing the transportation liquid, transferring the heated and thoroughly impregnated fiber material from the impregnation zone to the concurrent cooking zone;

while transferring the heated and impregnated fiber material, supplying at least 70% of a total amount of a cooking liquor to the concurrent cooking zone of the digester;

while supplying the cooking liquor, obtaining a first level of effective alkaline that is between 45 grams per liter and 55 grams per liter at the beginning of the concurrent cooking zone;

while obtaining the first level of effective alkaline, withdrawing spent liquor, that have passed through the concurrent cooking zone of the digester, at the strainer girdle of the digester, the spent liquor having an effective alkali level of at least 20 grams per liter and a temperature of between 130 degrees Celsius and 150 degrees Celsius;

passing between 90% and 100% of the spent liquor withdrawn through the flash tank;

while passing the spent liquor through the flash tank, transferring the spent liquor in the flash tank to the impregnation zone;

removing pulp from the bottom portion of the digester;

maintaining a second temperature at the beginning of the concurrent cooking zone that is higher than the first temperature of the impregnation zone, the second temperature being between 140 degrees Celsius and 155 degrees Celsius, the zone temperature being between 7 degrees Celsius and 15 degrees Celsius higher than the second temperature; and while maintaining the second temperature at the beginning of the concurrent cooking zone, obtaining a level of effective alkaline in the lowermost portion of the counter-current cooking zone that is at least 25 grams per liter lower than the first level of effective alkaline at the beginning of the concurrent cooking zone.

* * * * *